US008573540B2

(12) United States Patent
Bonieux

(10) Patent No.: US 8,573,540 B2
(45) Date of Patent: Nov. 5, 2013

(54) SYSTEM FOR TRIMMING A KITE

(75) Inventor: Louis Jerome Bonieux, Cottesloe (AU)

(73) Assignee: Boards & More GmbH, Molln (AT)

( * ) Notice: Subject to any disclaimer, the term of this patent is extended or adjusted under 35 U.S.C. 154(b) by 113 days.

(21) Appl. No.: 13/388,498

(22) PCT Filed: Jul. 29, 2010

(86) PCT No.: PCT/AU2010/000952

§ 371 (c)(1),
(2), (4) Date: Feb. 2, 2012

(87) PCT Pub. No.: WO2011/014904

PCT Pub. Date: Feb. 10, 2011

(65) Prior Publication Data

US 2012/0126063 A1 May 24, 2012

(30) Foreign Application Priority Data

Aug. 3, 2009 (AU) ..... 2009903593
Jan. 27, 2010 (AU) ..... 2010900306

(51) Int. Cl.
*A63H 27/00* (2006.01)

(52) U.S. Cl.
USPC ..... 244/155 A

(58) Field of Classification Search
USPC ..... 244/155 A, 153, 155 R; 114/39.16, 39.18
See application file for complete search history.

(56) References Cited

U.S. PATENT DOCUMENTS

| | | | | |
|---|---|---|---|---|
| 2,388,478 | A | 11/1945 | Garber | |
| 3,830,188 | A * | 8/1974 | Humbert | 441/69 |
| 4,129,273 | A * | 12/1978 | Hill | 244/155 A |
| 5,366,182 | A * | 11/1994 | Roeseler et al. | 244/155 R |
| 7,182,294 | B2 * | 2/2007 | Blackman | 244/155 A |
| 8,398,030 | B2 * | 3/2013 | Lawson | 244/155 A |
| 2002/0084384 | A1 | 7/2002 | Bellacera | |
| 2004/0182968 | A1 * | 9/2004 | Gentry | 244/155 A |
| 2012/0018584 | A1 * | 1/2012 | Lawson | 244/155 A |

FOREIGN PATENT DOCUMENTS

| | | | |
|---|---|---|---|
| AU | 12782/76 | A | 10/1977 |
| DE | 2933050 | A1 | 2/1981 |

OTHER PUBLICATIONS

International Search Report issued Sep. 23, 2010 from International Patent Application No. PCT/ AU2010/000952-2 pages.

* cited by examiner

*Primary Examiner* — Philip J Bonzell
(74) *Attorney, Agent, or Firm* — Boyle Fredrickson, S.C.

(57) ABSTRACT

A system for trimming a kite having first and second lines, first ends of which are secured to a first side to the kite. The system comprises a bar having a hollow interior and at least one spool secured at a first end of the bar such that second ends of the first and second lines are each secured to one of the spools. A winder is provided such that actuation of the winder rotates each spool. The first line extends from the kite to the first end of the bar and the second line extends from the kite to a second end of the bar and through the hollow interior of the bar to the first end of the bar.

24 Claims, 20 Drawing Sheets

SYSTEM FOR TRIMMING A KITE

RELATED APPLICATIONS

This is the U.S. national stage application which claims priority under 35 U.S.C. §371 to International Patent Application No.: PCT/AU2010/000952 filed on Jul. 29, 2010, which claims priority to Australian Patent Application Nos. 2009903593 filed Aug. 3, 2009 and 2010900306 filed Jan. 27, 2010, the disclosures of which are incorporated by reference herein their entireties.

FIELD OF THE INVENTION

The present invention relates to a system for trimming a kite of the type used predominantly in kite surfing.

BACKGROUND TO THE INVENTION

Kite surfing is becoming an increasingly popular sport. The sport involves the use of a kite secured to the user to provide lift and forward motion by the force of the wind. A kite will generally include two lines on each end of the kite. The front lines of the kite are connected together and to a body harness worn by the kite surfer and the rear lines are fixed to opposed ends of a bar held by the kite surfer. Pulling on the bar pulls or releases the rear lines and steers the kite left or right.

The power provided by the kite is related to the angle at which the kite is set, based on the relative lengths of the front and rear lines. Trimming the kite is generally accomplished by adjusting the length of the front lines after the point they join together before the common line enters the bar. Such a system is used because adjusting the rear lines would require precise adjustment of both lines at the same time and by the same length. The kite surfer would have to use both hands to adjust the kite power and therefore would not be able to control the kite during the adjustment.

The front lines of the kite however have more force on them than the rear lines. Therefore adjusting the front lines by the known method requires both significant force to be applied during adjustment and requires the kite surfer to reach forward to the adjustment mechanism, both of which reduce the control the kite surfer has over the kite during adjustment.

The present invention relates to a system directed to allow precise adjustment of both of the rear lines of the kite, thereby avoiding the above-mentioned problems associated with adjusting the front lines of the kite.

SUMMARY OF THE INVENTION

According to one aspect of the present invention there is provided a system for trimming a kite having first and second lines, first ends of which are secured to a first side to the kite, the system comprising:

a bar having a hollow interior, the bar to be held in use to control the kite;

at least one spool secured at a first end of the bar such that second ends of the first and second lines are each secured to one of the spools; and a winder provided such that actuation of the winder rotates each spool;

wherein the first line extends from the kite to the first end of the bar and the second line extends from the kite to a second end of the bar and through the hollow interior of the bar to the first end of the bar.

Preferably the system further comprises:

a first housing provided on the first end of the bar in which is provided the spools; and a second housing provided on a second end of the bar;

wherein the first line passes from the kite into the first housing and the second line passes into the second housing, around a roller and then through the hollow interior of the bar to the first housing.

Preferably there is provided a first spool and a second spool such that the second end of the first line is secured to the first spool and the second end of the second line is secured to the second spool.

The first and second spools are preferably mounted to a first shaft such that rotation of the first shaft rotates the first and second spools to either wind the first and second lines onto or off the first and second spools.

In one embodiment, the first shaft is oriented parallel to the bar and the winder comprises a rotatable arm secured to the first shaft such that rotation of the arm turns the first shaft.

The first housing preferably includes a first side wall secured adjacent the end of the bar and a second side wall remote from the bar and the first shaft extends through the second side wall such that the rotatable arm is secured to the first housing adjacent the second side wall.

The first housing may include front and rear walls being parallel to the longitudinal axis of the bar and oriented generally vertically in use and top and bottom walls.

In one embodiment, the first side wall includes a cylindrical protrusion into which is received the first end of the bar. The first line preferably extends downwardly through an opening in the top wall directly to the first spool.

In one embodiment, the second housing includes a first side wall secured adjacent the end of the bar, a second side wall remote from the bar, front and rear walls being parallel to the longitudinal axis of the bar and top and bottom walls. Preferably the first side wall includes a cylindrical protrusion in which is received the second end of the bar.

Preferably the second line enters the second housing through an opening in the top wall and passes around a roller provided in the second housing and out through an opening in the cylindrical protrusion into the hollow interior of the bar.

Preferably the second line enters the first housing towards a location between the first shaft and the bottom wall and a further roller is provided between the bottom wall and the spools such that the second line passes around the further roller and upwardly to the second spool.

In a preferred embodiment, the rotatable arm comprises an elongate plate secured to the first end of the first shaft including transverse handles at opposed ends thereof such that the transverse handles can be grasped by the kite surfer to turn the arm, thereby turning the first shaft.

In a preferred embodiment, a latch mechanism is provided in the first housing such that the latch mechanism allows rotation of the arm in a direction to wind the lines onto the spools but only allows rotation of the arm in the opposite direction by a limited amount.

The latch mechanism preferably allows rotation of the arm in the second direction by at most one half a rotation.

Preferably the latch mechanism comprises:

a latch pin provided in the first housing; and protrusions provided on opposed ends of the arm;

wherein each protrusion includes a first surface provided such that when the arm rotates in a first direction the first end of the latch pin rides up the first surface forcing the first end of the latch pin into the first housing and a second surface such that when the arm rotates in a second direction the first end of the latch pin engages with the second surface to prevent further rotation of the arm.

The latch pin is preferably spring biased to move towards the arm. The spring bias may be provided by an elastic cord connected between the first housing and a second end of the latch pin.

In a further embodiment, a worm gear is provided mounted between the first and second side walls of the first housing secured to the winder and the first shaft is provided with a first gear wheel thereon such that rotation of the worm gear rotates the first shaft via a gearing arrangement.

The gearing arrangement preferably includes further gear wheels connecting the worm gear to the first gear wheel to increase the angle of rotation of the first shaft per revolution of the worm gear relative to a direct connection between the worm gear and the first gear wheel.

Preferably there is provided a second shaft secured between the front and rear walls of the first housing including a second gear wheel and a third gear wheel mounted thereon such that the second gear wheel engages with the worm gear and the third gear wheel engages with the first gear wheel on the first shaft.

A limiter may also be provided to limit the extent of rotational movement of the first shaft. The limiter preferably comprises a limiter gear wheel engaging with the worm gear and having an irregular shaped cog such that when the irregular shaped cog engages with the worm gear, further rotation of the worm gear in that direction is prevented.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
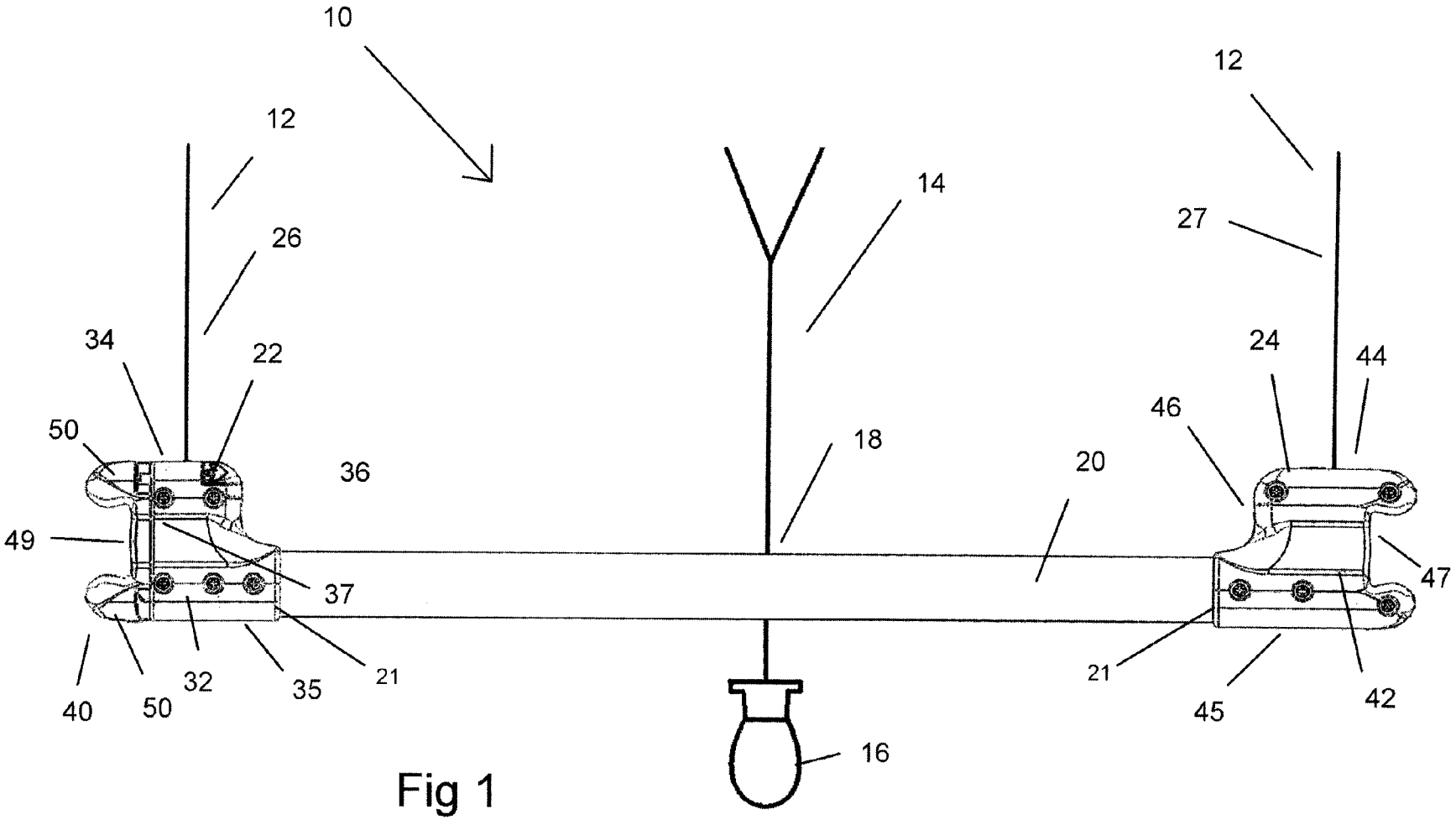
FIG. 1 is a front view of a system for trimming a kite in accordance with the present invention.
Figure 2:
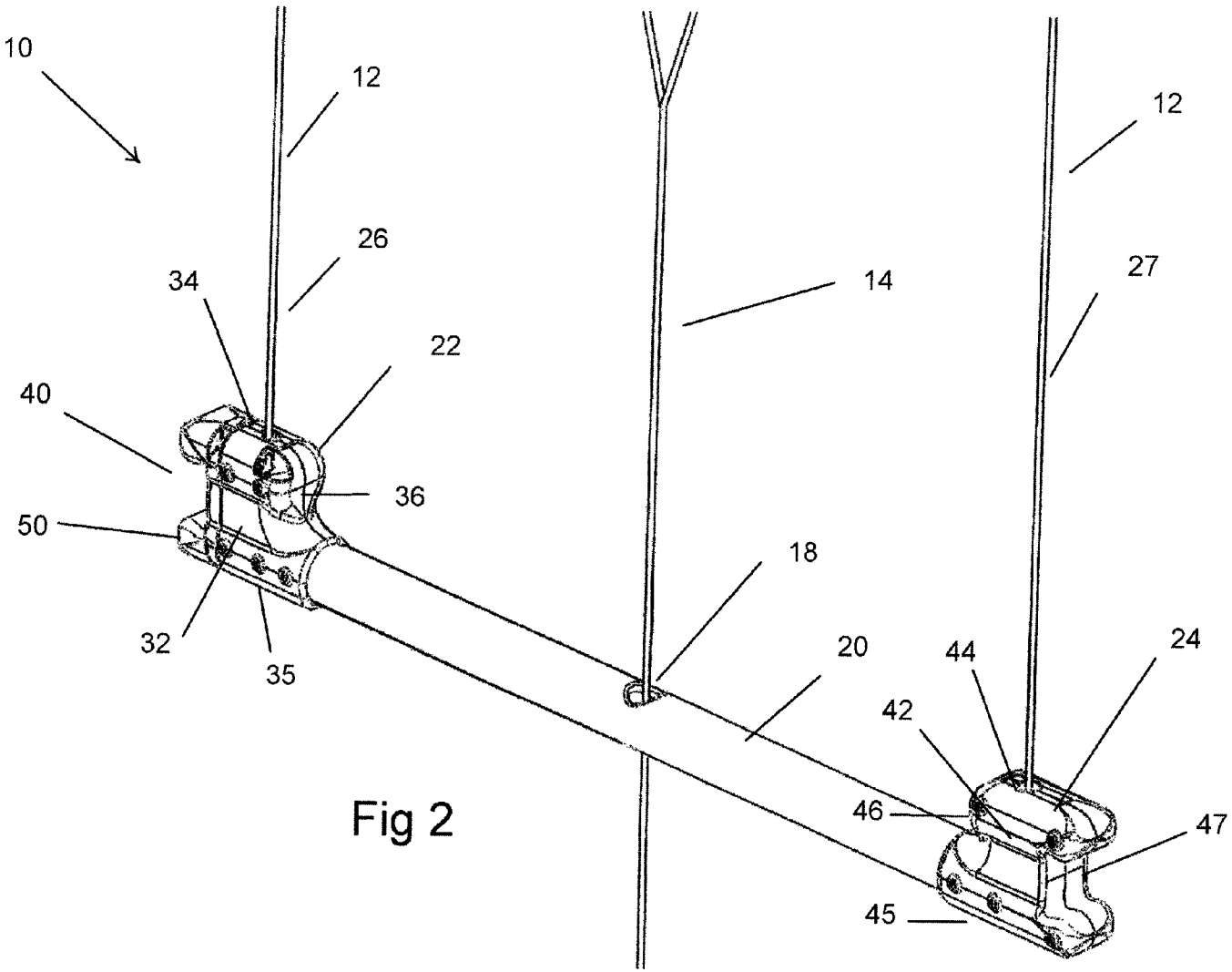
FIG. 2 is an upper perspective view of the system of FIG. 1.
Figure 3:
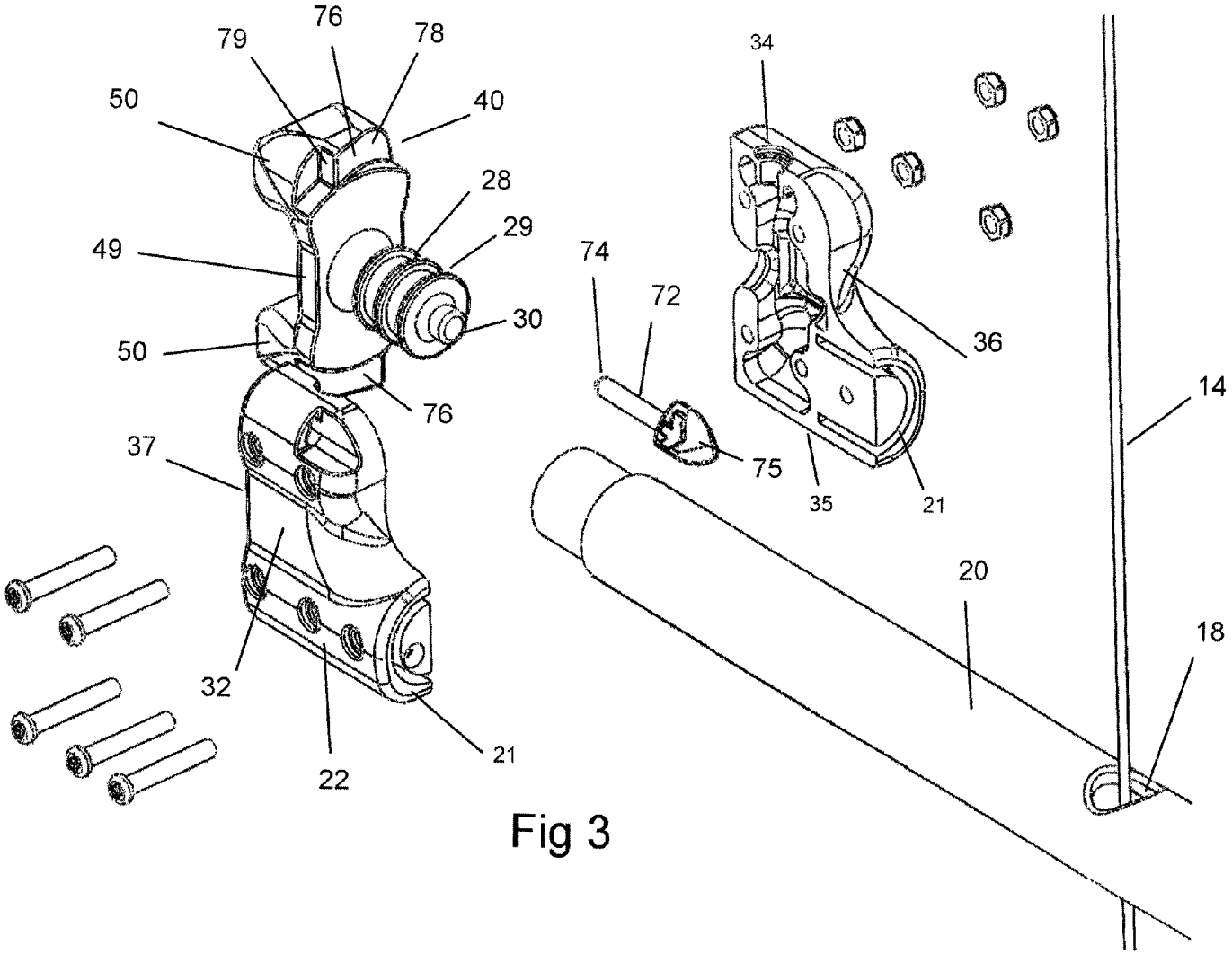
FIG. 3 is an exploded view of the first housing of the system of FIG. 1.
Figure 4:
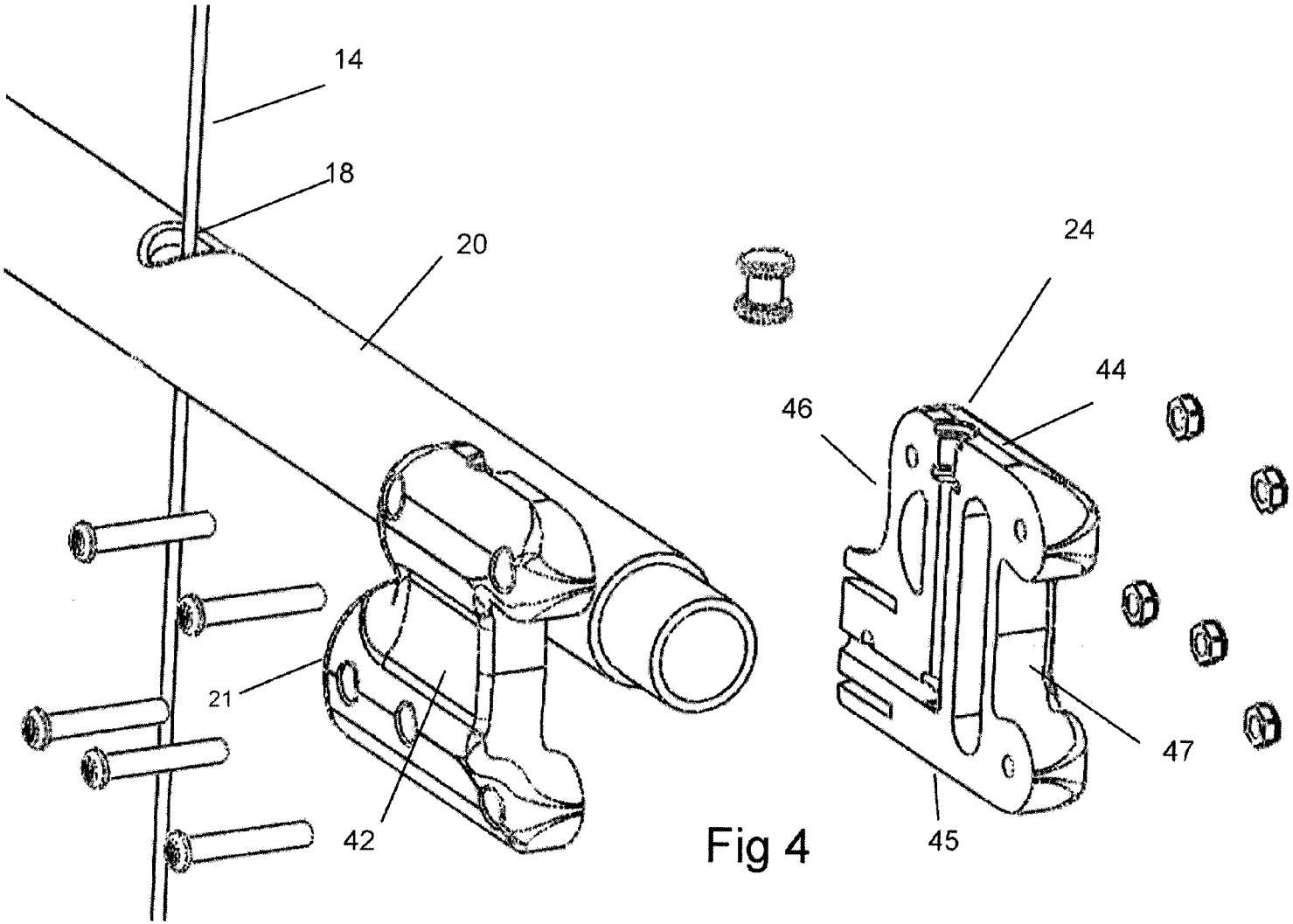
FIG. 4 is an exploded view of the second housing of the system of FIG. 1.
Figure 5:
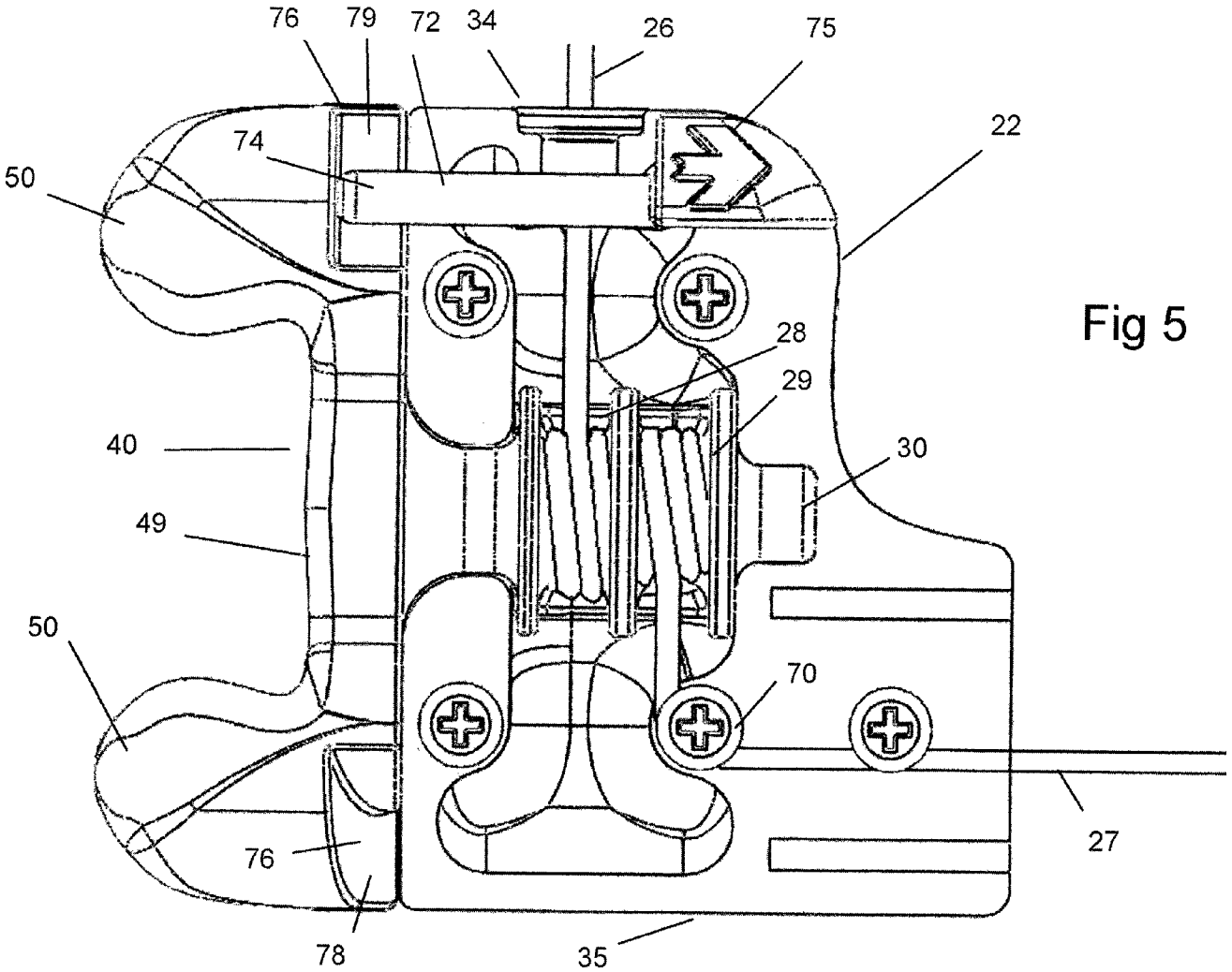
FIG. 5 is a cross sectional view of the first housing of the system of FIG. 1.

Referring to FIGS. 1 to 10, there is shown a system 10 for trimming a kite. The kite in the embodiment shown includes a first pair of lines 12 connected to a rear side of the kite and a second pair of lines 14 connected to a front side of the kite. First ends of the second pair of lines 14 are secured to the kite and second ends thereof are secured together and connected to a securing loop 16 which is connectable to a harness of the kite surfer. The joined second ends of the second lines 14 pass through a hole 18 in a bar 20 in a known manner. First ends of the first lines 12 extend from a rear side of the kite. The first lines 12 extend from the kite towards opposed ends of the bar 20 which is held by the kite surfer in use.

The bar 20 is provided with a first housing 22 on a first end thereof and a second housing 24 on a second end thereof. The first lines 12 comprise a first line 26 and a second line 27. A second end of the first line 26 is secured within the first housing 22. The second line 27 extends from the kite into the second housing 24 on the second end of the bar 20 and passes from the second housing 24 through a hollow interior of the bar 20 into the first housing 22. The second end of the second line 27 is also secured within the first housing 22.

The system 10 is provided with at least one spool within the first housing 22 to which the second ends of the first pair of lines 12 are secured. In the embodiment shown, the first housing 22 is provided with a first spool 28 and a second spool 29. The first and second spools 28 and 29 are each provided on a first shaft 30 mounted for rotation within the first housing 22.

The first housing 22 is generally a rectangular prism in shape comprising front and rear walls 32 and 33, first and second side walls 36 and 37 and top and bottom walls 34 and 35. The front and rear walls 32 and 33 are parallel to the longitudinal axis of the bar 20 and generally oriented vertically in use. The first side wall 36 is secured adjacent the end of the bar 20 and the second side wall 37 is located remote from the bar 20. The first side wall 36 includes a cylindrical protrusion 21 into which is received an end of the bar 20.

In the embodiment shown, the first housing 22 is provided in two vertical halves securable together. That is, the housing 22 is split through the first and second side walls 36 and 37 and the top and bottom walls 34 and 35.

The first and second spools 28 and 29 are both provided on the first shaft 30 for receiving the first and second lines 26 and 27 respectively. The first shaft 30 is oriented parallel to the bar 20 extending from the second side wall 37 towards the first side wall 36.

The first line 26 extends in use downwardly through an opening in the top wall 34 and the second end thereof is secured to the first spool 28. The second line 27 passes from the hollow interior of the bar 20 through an opening in the first side wall 36 in the cylindrical protrusion 21 and the second end thereof is secured to the second spool 29. The second line 27 enters the first housing 22 towards a location between the first and second spools 28 and 29 and the bottom wall 35. A roller 70 is provided between the bottom wall 35 and the spools 28 and 29 such that the second line 27 passes around the roller 70 and upwardly to the second spool 29.

The second ends of the first and second lines 26 and 27 are secured to the first and second spools 28 and 29 such that rotation of the first and second spools 28 and 29 in a first direction causes both the first and second lines 26 and 27 to be wound onto the first and second spools 28 and 29, thereby shortening the length of the first pair of lines 12.

The second housing 24 is also generally a rectangular prism in shape comprising front and rear walls 42 and 43, first and second side walls 46 and 47 and top and bottom walls 44 and 45. The front and rear walls 42 and 43 are parallel to the longitudinal axis of the bar 20 and generally oriented vertically in use. The first side wall 46 is secured adjacent the end of the bar 20 and the second side wall 47 is located remote from the bar 20. The first side wall 46 includes a cylindrical protrusion 21 into which is received an end of the bar 20.

Figure 6:
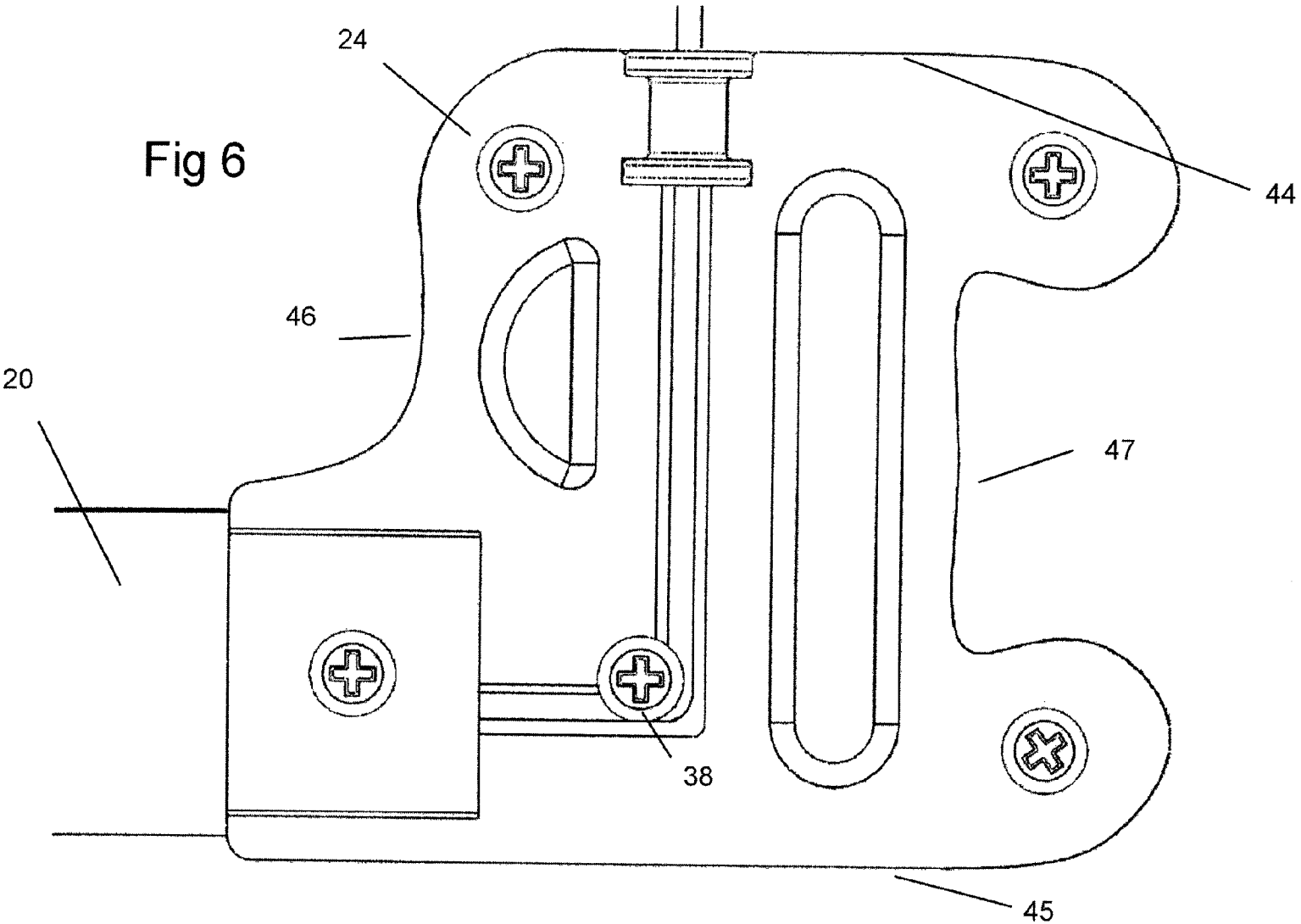
FIG. 6 is a cross sectional view of the second housing of the system of FIG. 1.
Figure 7:
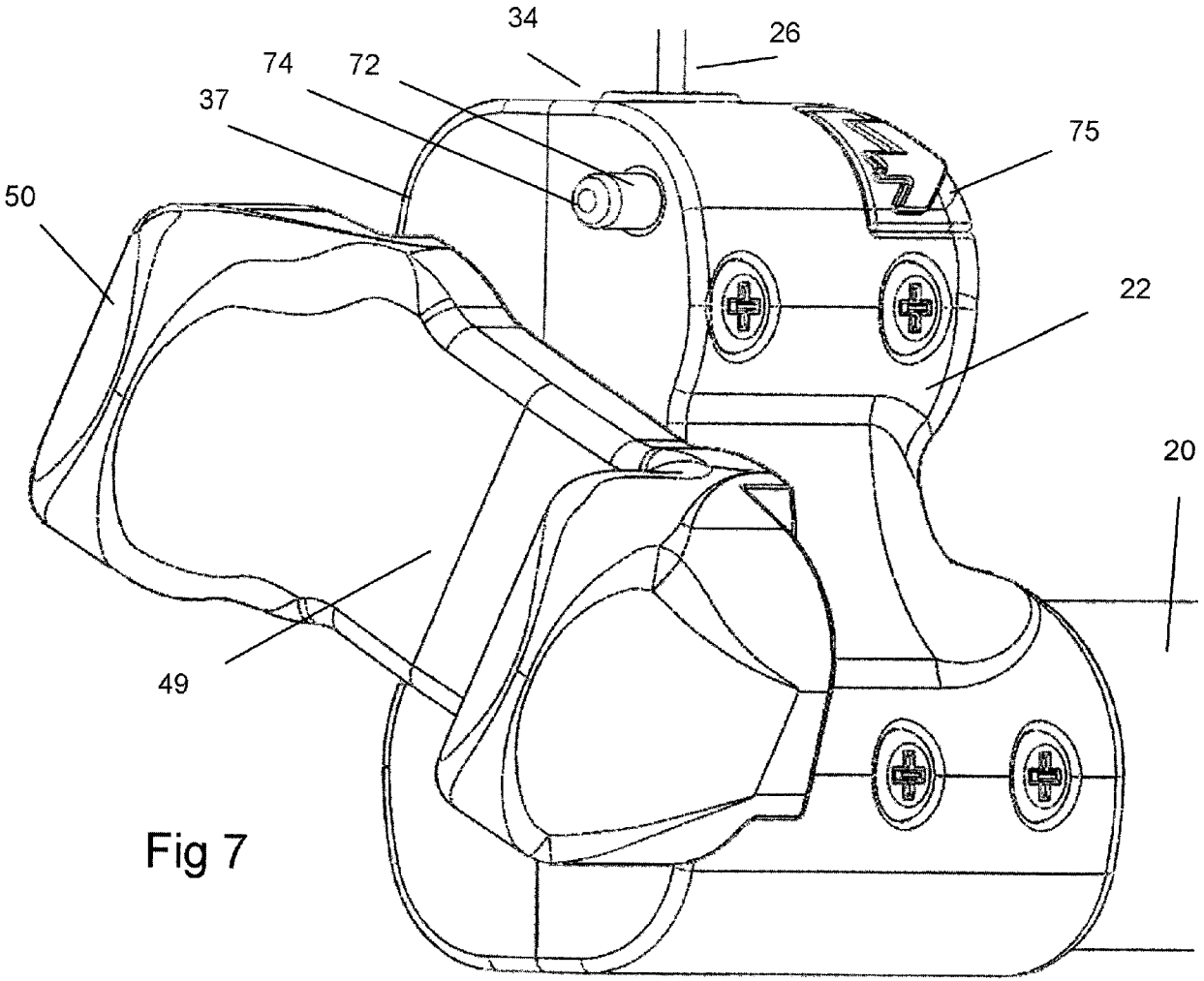
FIG. 7 is a perspective view of the first housing of the system of FIG. 1 showing the winder in a first position.

The second housing 24 includes a roller 38 (as best seen in FIG. 6) mounted between the front and rear walls 42 and 43. The second line 27 passes through an opening in the top wall 44, around the roller 38 and out through an opening in the cylindrical protrusion 21 into the hollow interior of the bar 20.

The system 10 for trimming a kite is also provided with a winder. The winder comprises a mechanism secured to the first housing 22 such that actuation of the winder causes rotation of the first and second spools 28 and 29. In the embodiment shown, the winder comprises a rotatable arm 40. The first shaft 30 passes through an opening in the second side wall 37 and the rotatable arm 40 comprises an elongate plate 49 secured to the first end of the first shaft 30. The elongate plate 49 includes transverse handles 50 at opposed ends thereof such that the transverse handles 50 can be grasped by the kite surfer to turn the arm 40, thereby turning the first shaft 30.

Rotation of the arm 40 thereby directly rotates the first shaft 30 and winds the first and second lines 26 and 27 either onto or off the first and second spools 28 and 29.

A latch mechanism is provided in the first housing 22 such that the latch mechanism allows rotation of the arm in a direction to wind the lines onto the spools but only allows rotation of the arm in the opposite direction by a limited amount. In the embodiment shown, the latch mechanism allows rotation of the arm 40 in a direction to wind the lines 26 and 27 onto the spools 28 and 29 but only allows rotation of the arm 40 in the opposite direction by at most one half a rotation at a time.

In the embodiment shown, the latch mechanism comprises a latch pin 72 provided in the first housing 22. The latch pin 72 is provided adjacent the top wall 34 and extends parallel to the bar 20 from a first end 74 that extends through the second side wall 37 to a second end 75 adjacent the first side wall 36. The first end 74 of the latch pin 72 engages with protrusions 76 provided adjacent each end of the arm 40 on a side of the arm 40 adjacent the first housing 22.

Figure 10:
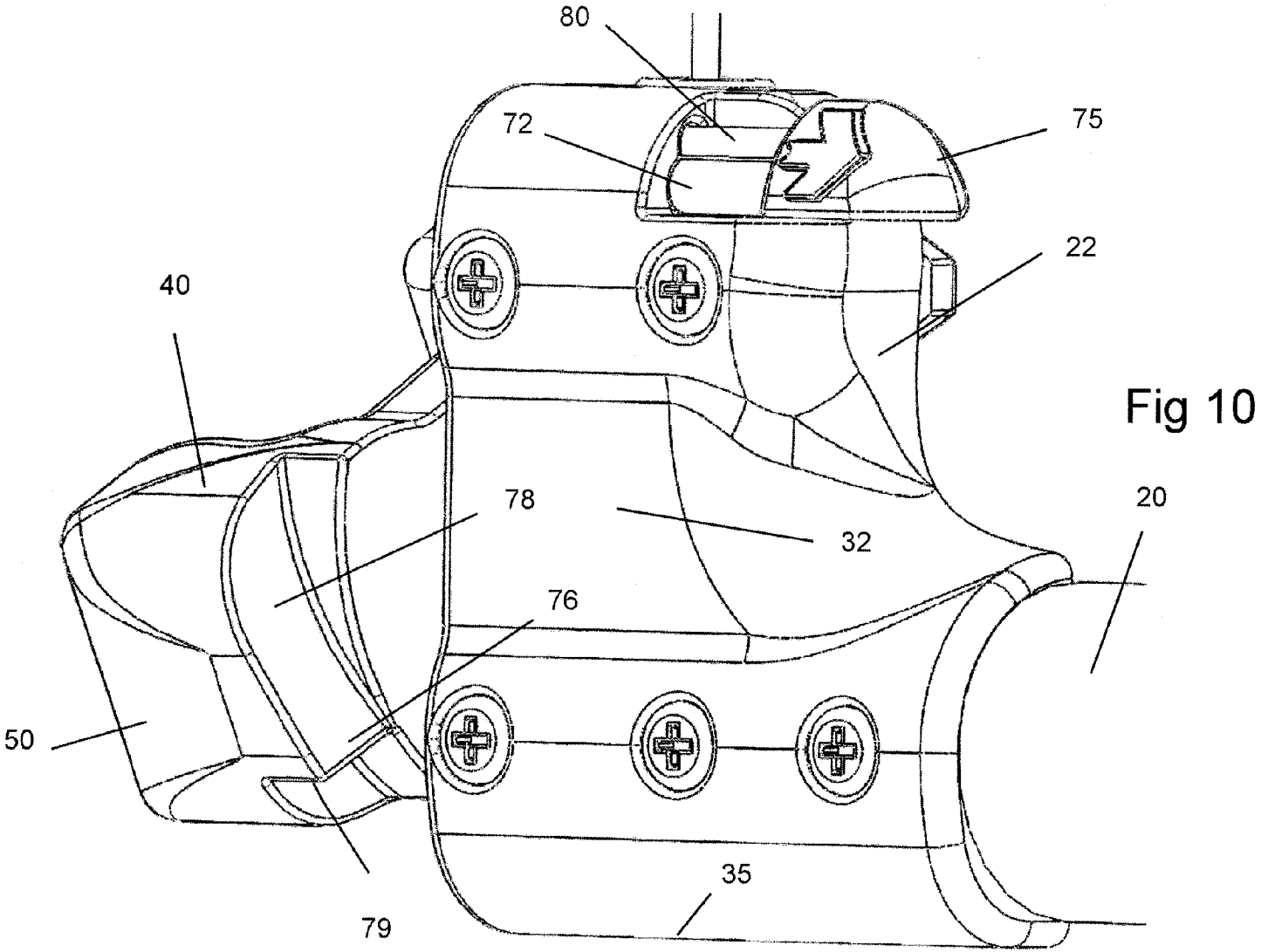
FIG. 10 is a perspective view of the first housing of the system of FIG. 1 showing release of the latch pin.

Each protrusion 76 includes a first surface 78 angled to the second side wall 37 of the first housing 22 such that when the arm 40 rotates in a first direction (being the direction that winds the lines 26 and 27 onto the spools 28 and 29) the first end 74 of the latch pin 72 rides up the first surface 78 forcing the first end 74 of the latch pin 72 into the first housing 22. The protrusion 76 includes a second surface 79 generally perpendicular to the second side wall 37 of the first housing 22 such that when the arm 40 rotates in a second direction (being the direction that would unwind the lines 26 and 27 from the spools 28 and 29) the first end 74 of the latch pin 72 engages with the second surface 79 to prevent further rotation of the arm 40. The latch pin 72 is spring biased to move towards the arm 40. The spring bias is preferably provided by an elastic cord 80 (as seen in FIG. 10) connected between the first housing 22 and the second end 75 of the latch pin 72.

Figure 8:
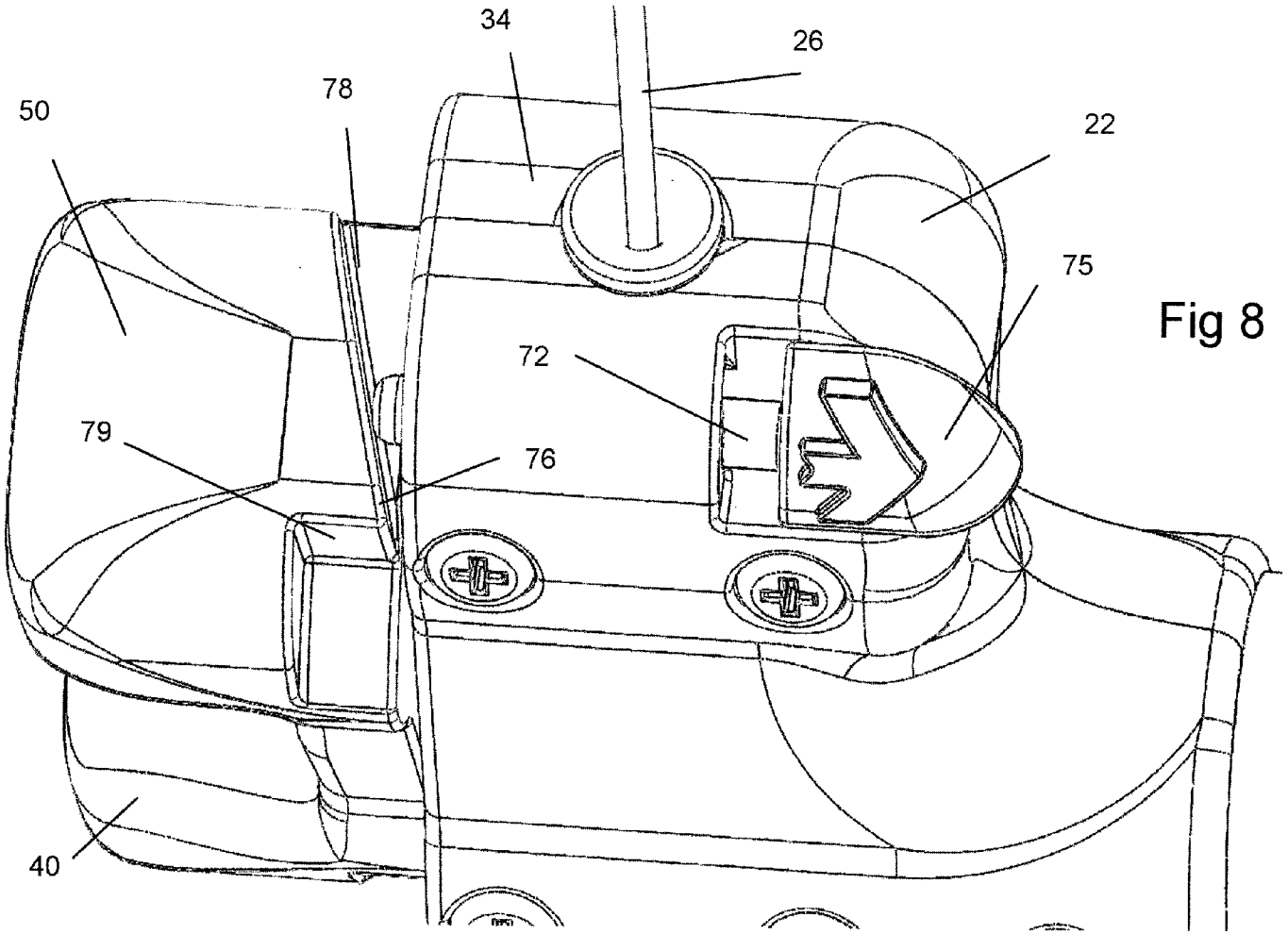
FIG. 8 is a perspective view of the first housing of the system of FIG. 1 showing the winder in a second position.
Figure 9:
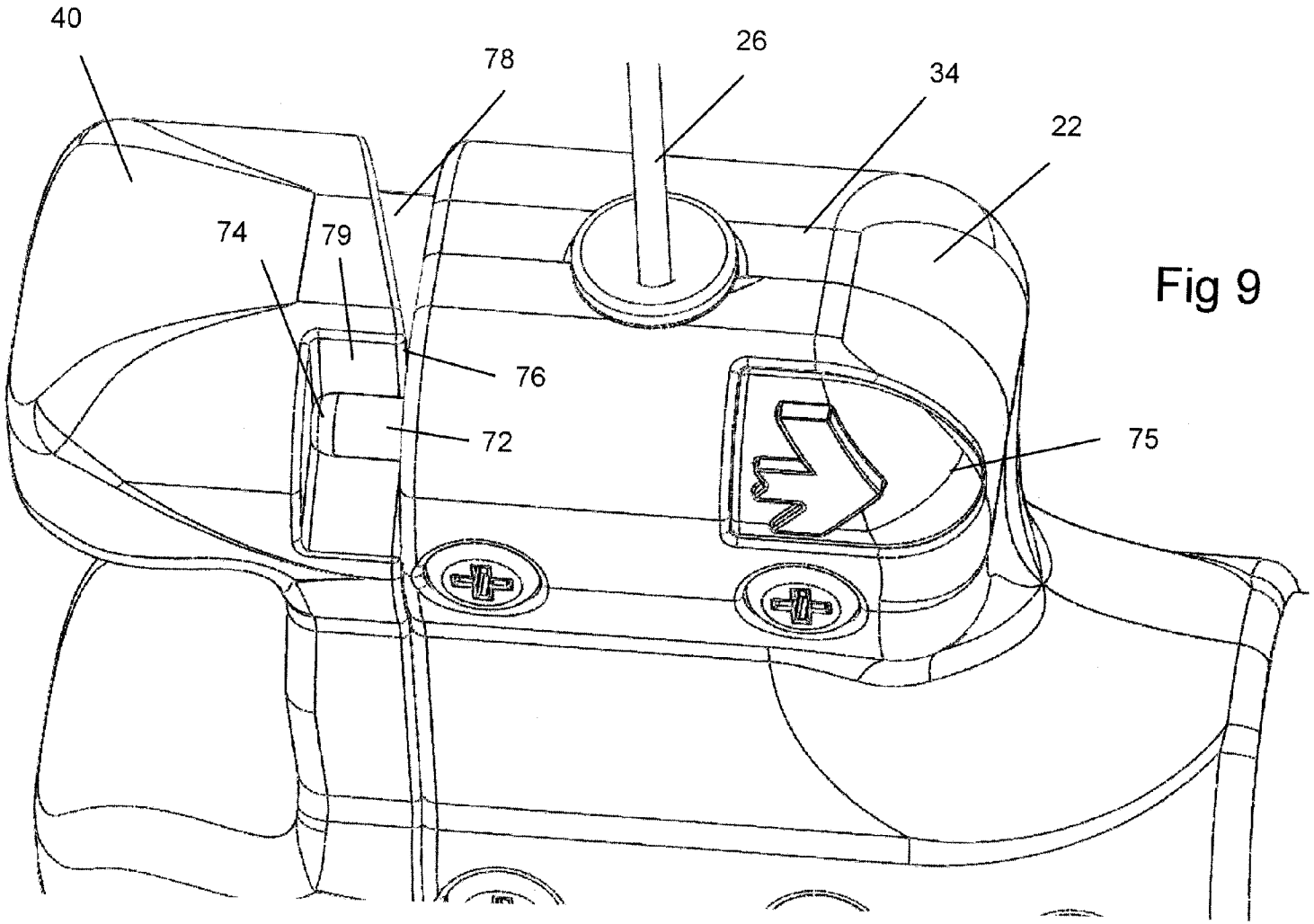
FIG. 9 is a perspective view of the first housing of the system of FIG. 1 showing the winder in a third position.

In use, when it is desired to shorten the lines 26 and 27, the arm 40 is rotated in the first direction. Each time an end of the arm 40 passes the latch pin 72, the first end 74 rides up over first surface 78 of the protrusion 76 forcing the latch pin 72 away from the arm 40 (as can be seen in FIG. 8). The spring bias then pulls the latch pin 72 back towards the arm 40 as the protrusion 76 passes. When the arm 40 is rotated in the opposite direction (as any tension on the lines 26 and 27 would tend to do), the arm 40 rotates until the first end 74 of the latch pin 72 engages with the second surface 79 on the protrusion 76 at the end of the arm 40 (as can be seen in FIG. 9). If it is desired to release the lines 26 and 27, the second end 75 of the latch pin 72 can be pushed away from the arm 40 to release the arm 40. The arm 40 can then rotated by the tension in the lines 26 and 27, allowing lines to be released. The unwinding can be controlled by pressure exerted on the outer surface of the arm 40 by the hand. When the latch pin 72 is released, it will move back to engage with the end of the arm 40 and prevent further rotation.

Figure 11B:
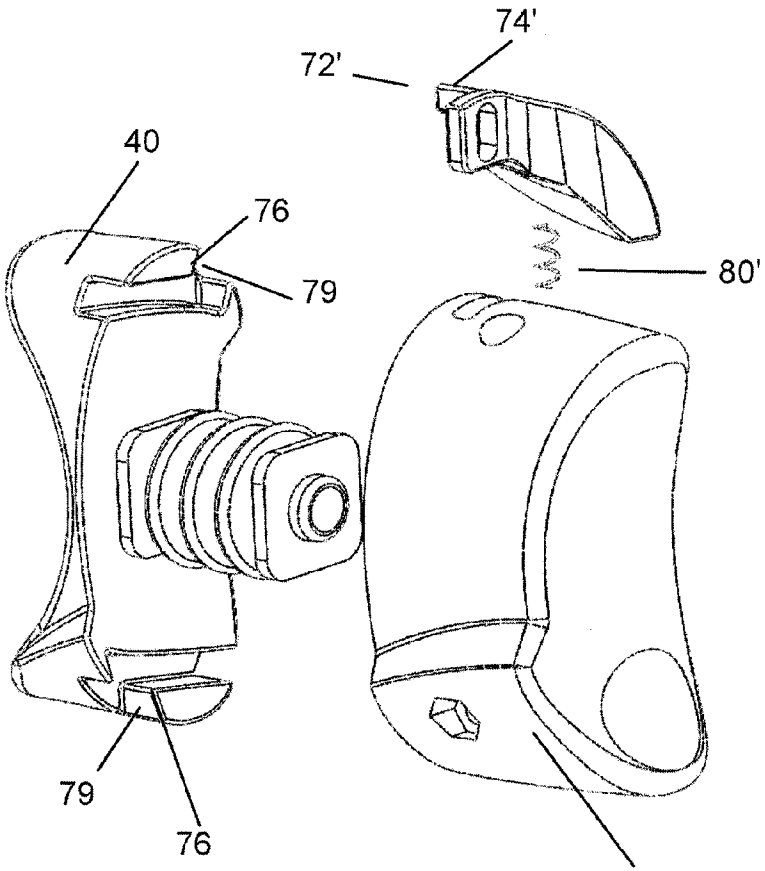
FIG. 11*b* is a rear exploded view of the first housing of FIG. 11*a;*
Figure 11A:
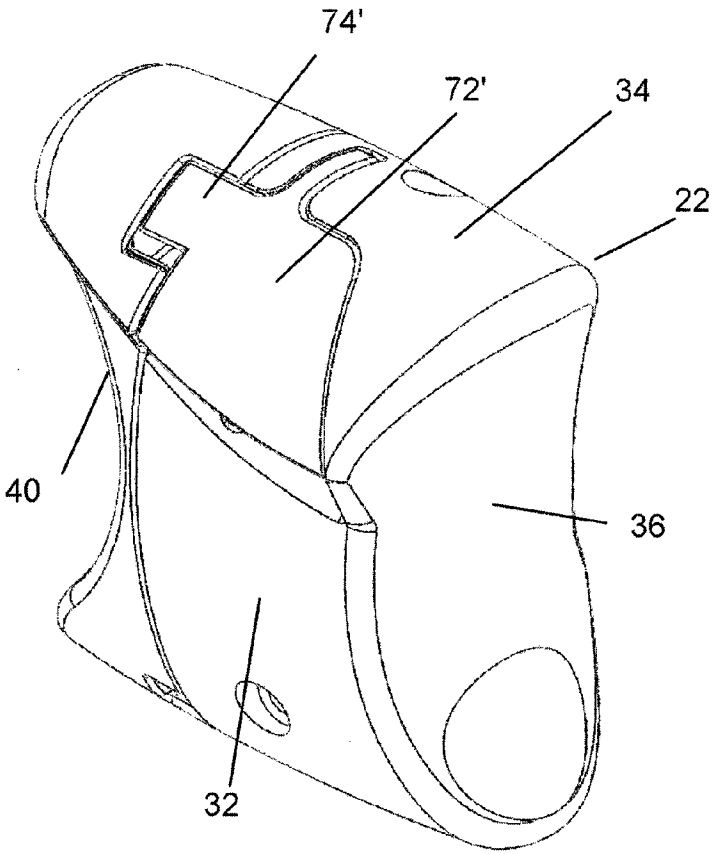
FIG. 11*a* is an upper perspective view of a first housing of the system for trimming a kite with an alternative latch mechanism.
Figure 12B:
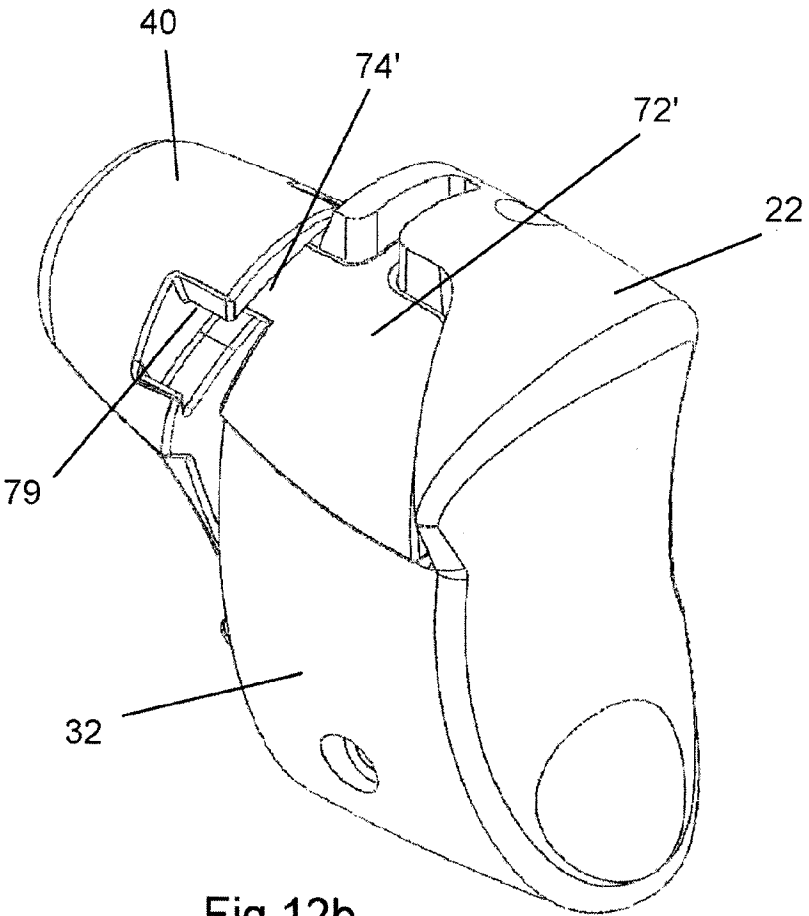
FIG. 12*b* is an upper perspective view of the first housing of FIG. 11 with the latch mechanism fully depressed.
Figure 12A:
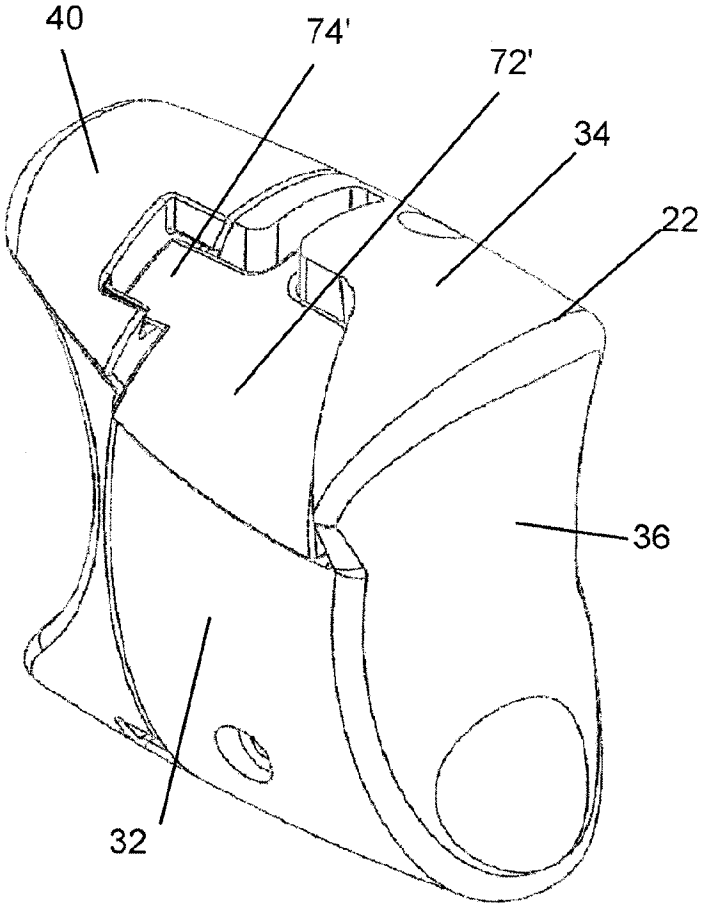
FIG. 12*a* is an upper perspective view of the first housing of FIG. 11 with the latch mechanism partially depressed.
Figure 13:
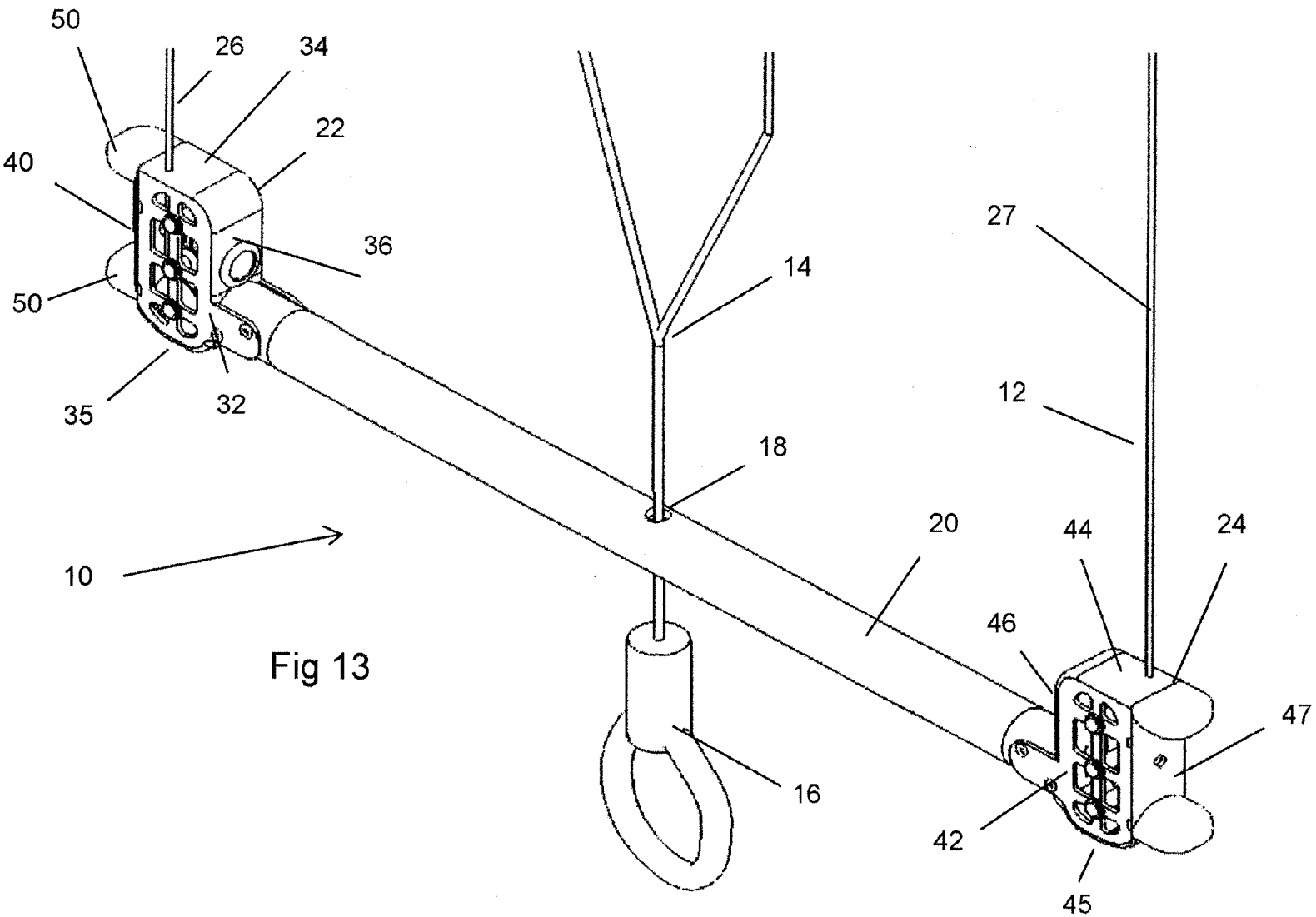
FIG. 13 is an upper perspective view of a second embodiment of a system for trimming a kite in accordance with the present invention.
Figure 14:
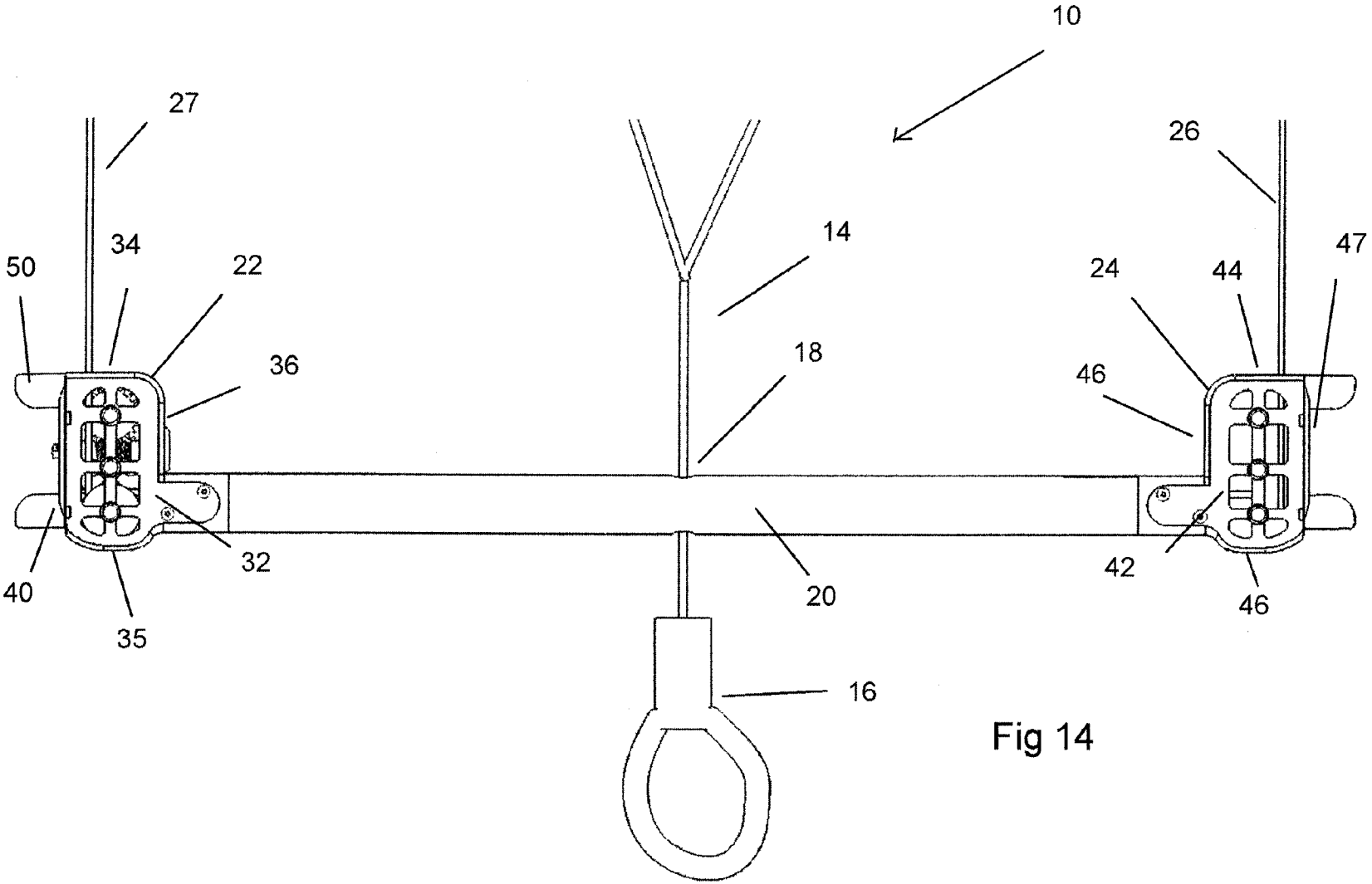
FIG. 14 is a front view of the system of FIG. 13.
Figure 15:
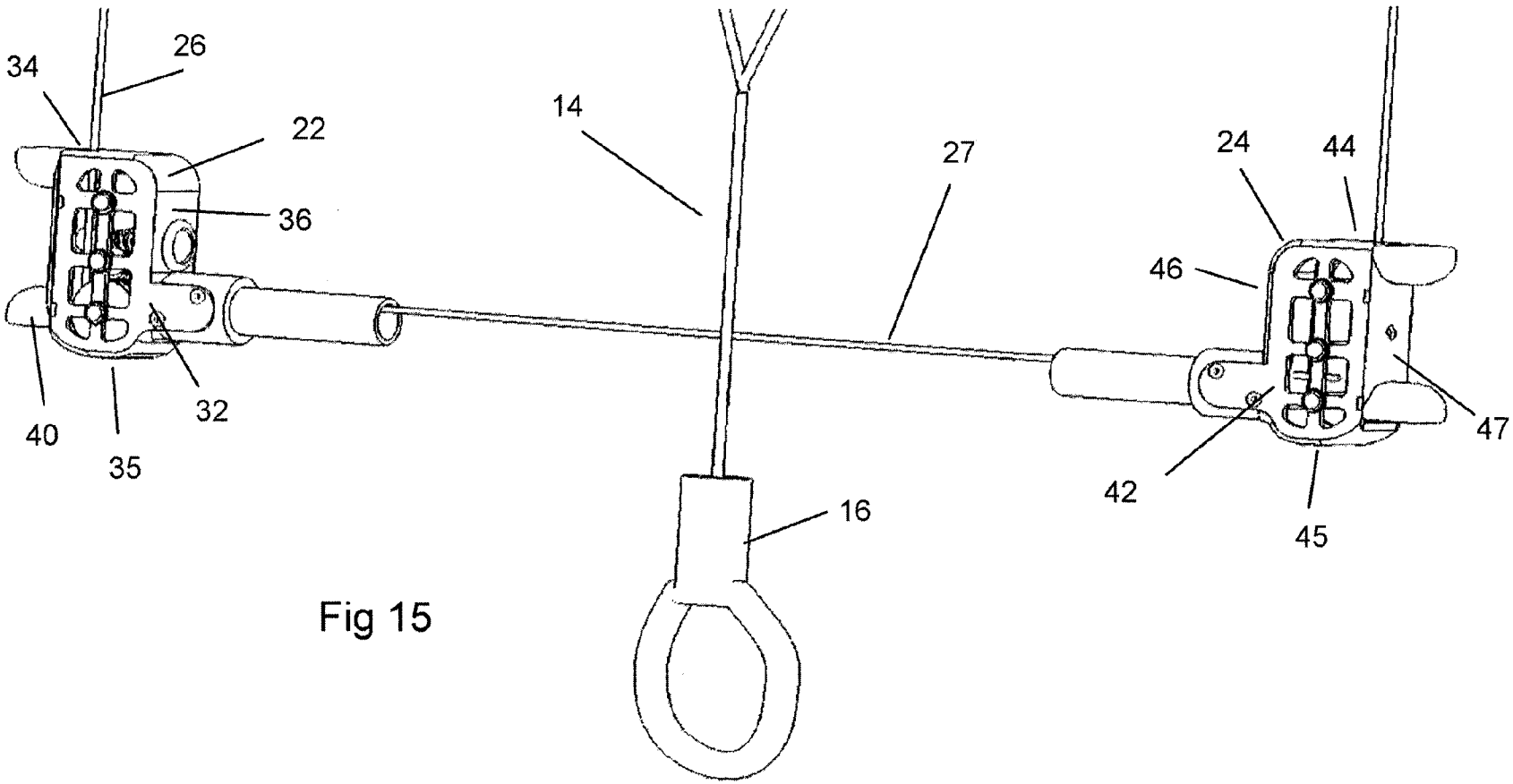
FIG. 15 is a view of the system of FIG. 13 with a portion of the bar cut away.
Figure 16:
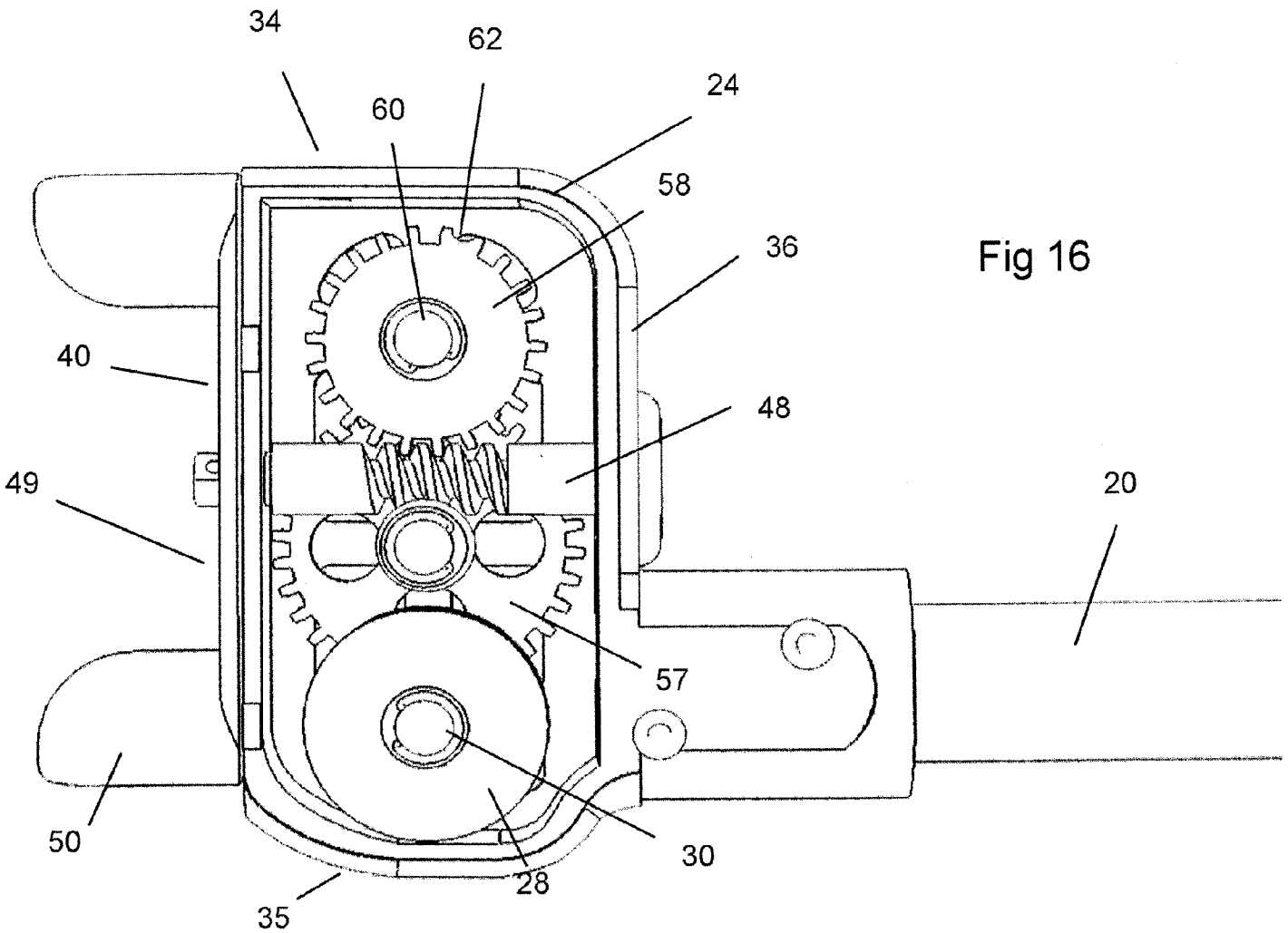
FIG. 16 is a front view of the first housing of FIG. 13 with the front wall of the housing removed.
Figure 17:
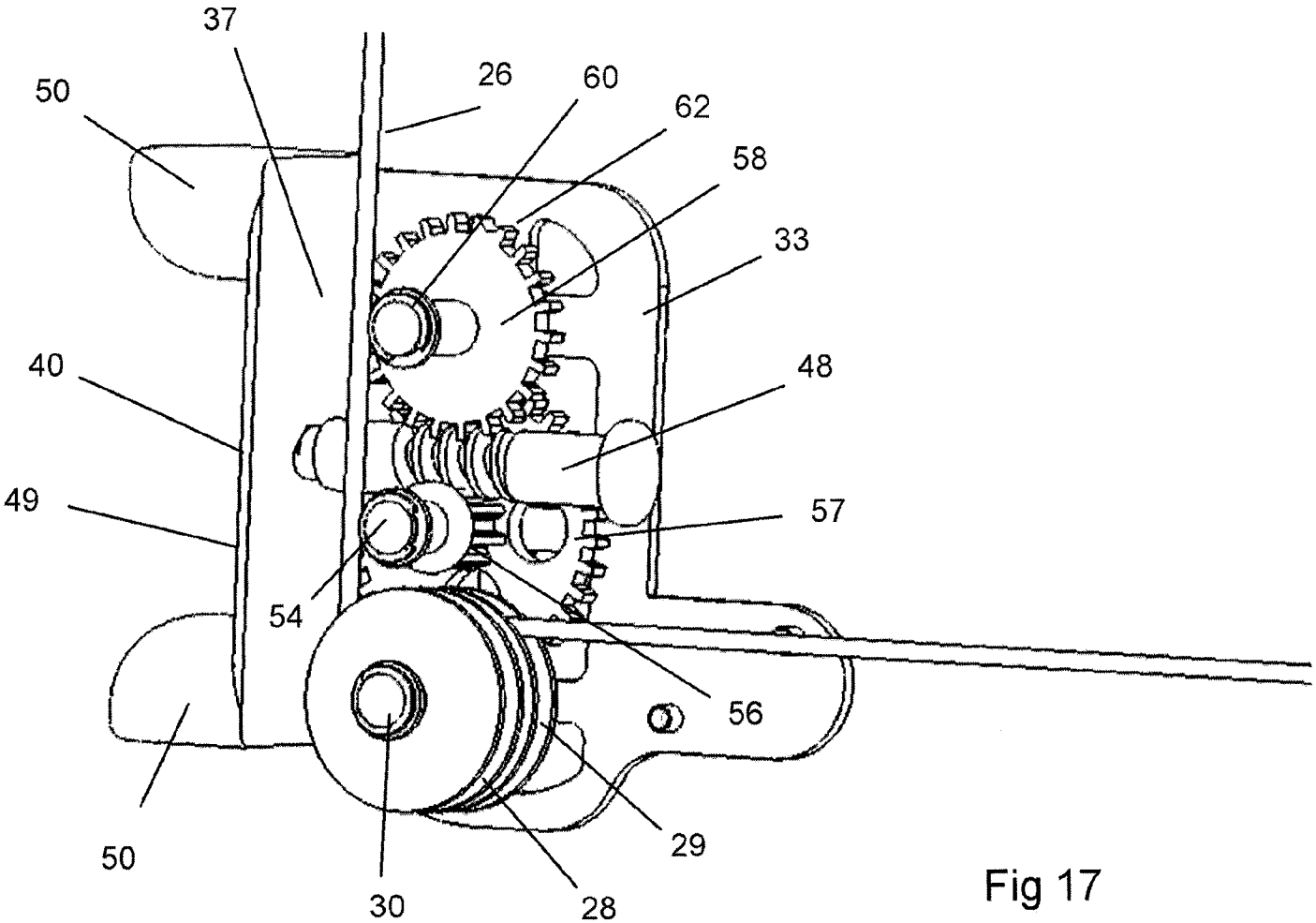
FIG. 17 is a front perspective view of the first housing of FIG. 13 with a portion of the housing cut away.
Figure 19:
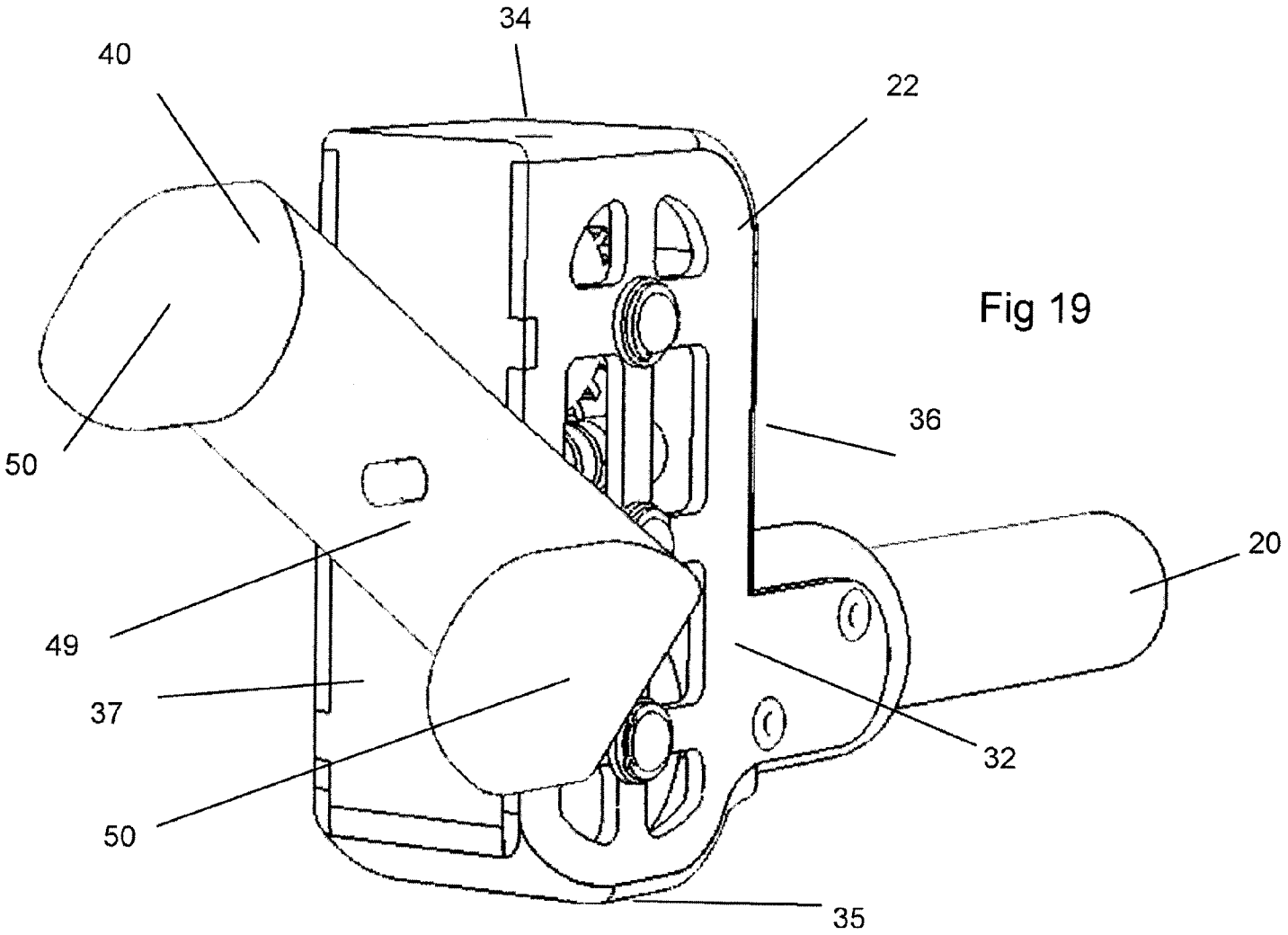
FIG. 19 is a perspective view of the first housing of the system of FIG. 13 showing operation of the winder.

FIGS. 11 and 12 show an alternative embodiment of the first housing 22 in which an alternative latch mechanism is provided. In the embodiment of FIGS. 19 and 22, the latch mechanism comprises a slidable latch member 72'. The slidable latch member 72' is located in a recess adjacent the upper surface 34 of the first housing 22 and can be depressed downwardly into the recess against a spring 80'. The latch member 72' includes a protruding lug 74' that engages with the protrusion 76 on the arm 40 when the latch member 72' is in its extended position (as shown in FIG. 11*a*). As the latch member 72' is depressed into the recess, the lug 74' moves towards the centre of the arm 40 and below the protrusion 76 such that the arm 40 is free to rotate in the same manner as the embodiment of FIGS. 1 to 10.

FIGS. 13 to 20 show a second embodiment of a system for trimming a kite 10. The second embodiment is similar to the first embodiment and like reference numerals are used to denote like parts.

In the embodiment of FIGS. 13 to 20, the first shaft 30 is mounted between the front and rear walls 32 and 33 perpendicular to the bar 20. The rotatable arm 40 is connected to the first shaft 30 by a gearing arrangement such that rotation of the rotatable arm 40 rotates the first shaft 30 via the gearing arrangement.

The gearing arrangement includes a worm gear 48 mounted between the first and second side walls 36 and 37 such that a first end thereof protrudes through the second side wall 37. The rotatable arm 40 comprises an elongate plate 49 secured to the first end of the worm gear 48.

Figure 18:
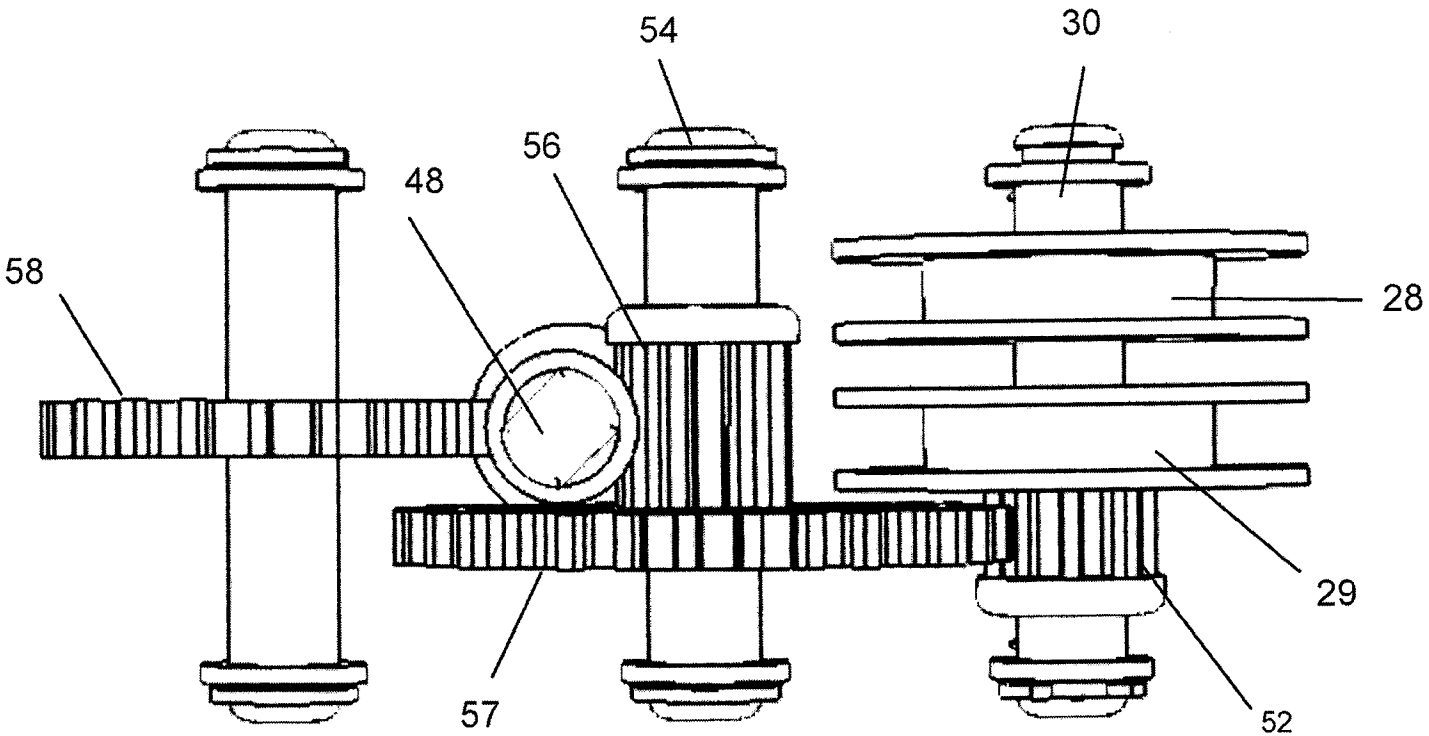
FIG. 18 is a top view of the gears and spool of the first housing of FIG. 13.

In the embodiment shown, the first shaft 30 is provided with a first gear wheel 52 thereon (as best seen in FIG. 18). The gearing arrangement also includes further gear wheels connecting the worm gear to the first gear wheel 52. The further gear wheels are provided to increase the angle of rotation of the first shaft 30 per revolution of the worm gear 48, relative to a direct connection between the worm gear 48 and the first gear wheel 52. There is provided a second shaft 54 secured between the front and rear walls 32 and 33 between the first shaft 30 and the worm gear 48. The second shaft 54 includes a second gear wheel 56 and a third gear wheel 57 mounted thereon. The second gear wheel 56 engages with the worm gear 48 and is smaller than the third gear wheel 57. The third gear wheel 57 engages with the first gear wheel 52 on the first shaft 30. Rotation of the worm gear 48 thereby causes rotation of the first shaft 30 via rotation of the second shaft 54.

The first housing 22 is also provided with a limiter to limit the extent of rotational movement of the first and second spools 28 and 29. This prevents too much of the first and second lines 26 and 27 being wound onto the first and second spools 28 and 29 and also prevents the first and second lines 26 and 27 being fully unwound. The limiter is provided in the form of a limiter gear wheel 58 mounted on a third shaft 60. The third shaft 60 is mounted between the front and rear walls 32 and 33 between the worm gear 48 and the top wall 34 such that the limiter gear wheel 58 engages with the worm gear 48. Rotation of the worm gear 48 thereby turns the limiter gear wheel 58. The limiter gear wheel 58 includes an irregular shaped cog 62 such that when the irregular shaped cog 62 engages with the worm gear 48, further rotation of the worm gear 48 in that direction is prevented.

Figure 20:
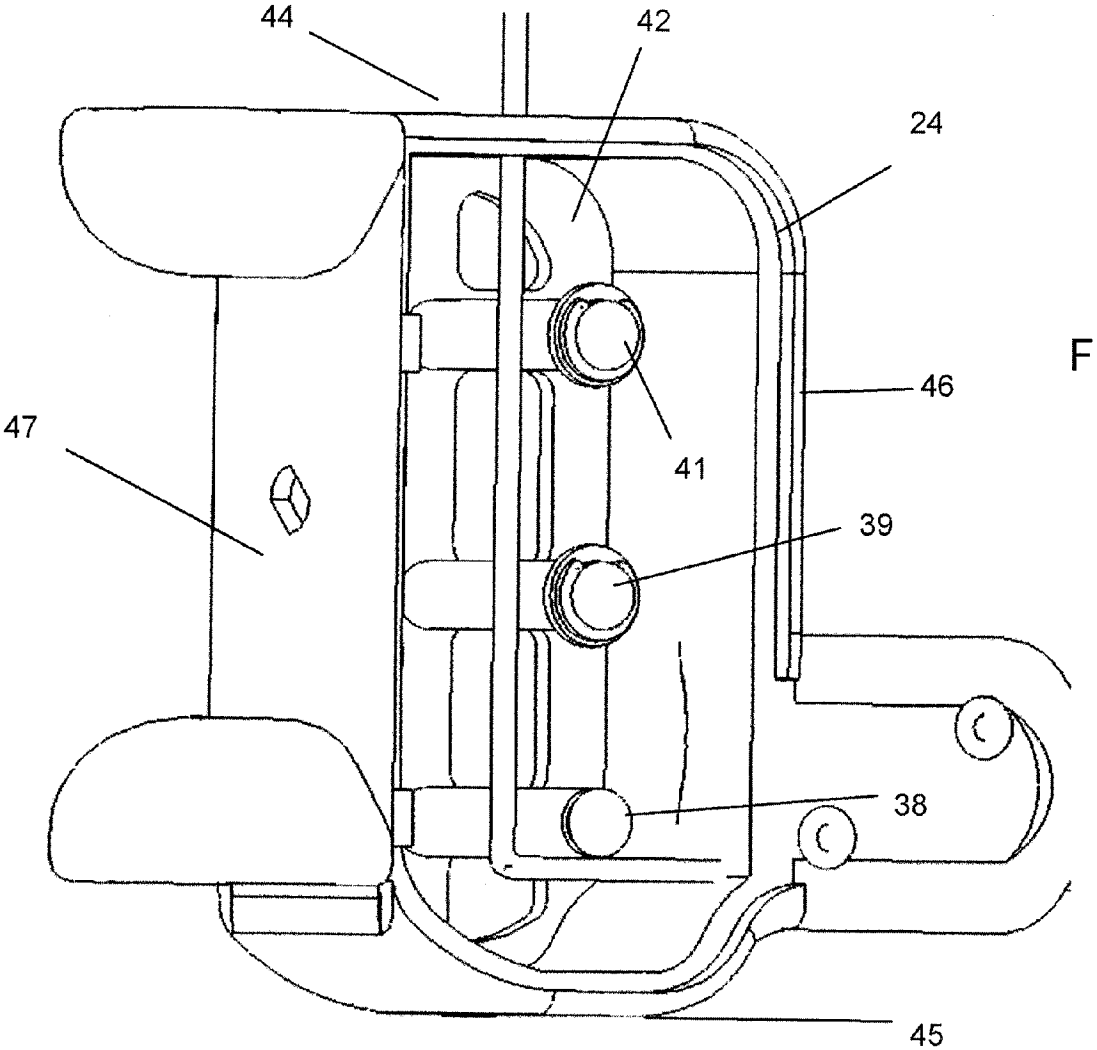
FIG. 20 is a rear perspective view of the second housing of the system of FIG. 13 with the rear wall removed.

Second and third rollers 39 and 41 may also be provided in the second housing 24 above the first roller 38 extending between the front and rear walls 42 and 43 (as shown in FIG. 20).

In the second embodiment, when it is desired to trim the kite by shortening the rear lines 12, the arm 40 can be wound in a first direction such that the first and second spools 28 and 29 turn and wind the first and second lines 26 and 27 onto the first and second spools 28 and 29. When the rear lines require extending, the arm 40 can be wound in a second opposite direction, thereby unwinding the first and second lines 26 and 27 from the first and second spools 28 and 29. The use of the worm gear 48 prevents the force on the lines 12 in use causing rotation of the spools 28 and 29 and unwinding of the lines 12.

The bar 20 may include a window portion (not shown) through which the second line 27 may be viewed. The second line 27 may include a marker on the portion visible through the window and one or more graduations may be provided on the window. The relative positions of the marker on the second line 27 and the graduations can therefore be used to provide an indication of the amount by which the lines 12 have been wound on to or off the spools 28 and 29.

It will be appreciated that the system of the present invention allows simultaneous adjustment of both of the rear lines of the kite at the same time. The adjustment is performed at the end of the bar and can be achieved by use of one hand only, allowing one hand to maintain control of the kite. The mechanism is also provided in a form that is compact and safely contained within the bar 20 and the housings 22 and 24 at the ends of the bar 20. The kite surfer can therefore trim the kite during use in a quicker, safer manner and with less force required in comparison to adjusting the length of the front lines.

It will be readily apparent to persons skilled in the relevant arts that various modifications and improvements may be made to the foregoing embodiments, in addition to those already described, without departing from the basic inventive concepts of the present invention.

The invention claimed is:

1. A system for trimming a kite having first and second lines, first ends of which are secured to a first side to the kite, the system comprising:

a bar having a hollow interior, the bar to be held in use to control the kite;

at least one spool secured at a first end of the bar such that second ends of the first and second lines are each secured to one of the spools; and a winder provided such that actuation of the winder rotates each spool;

wherein the first line extends from the kite to the first end of the bar and the second line extends from the kite to a second end of the bar and through the hollow interior of the bar to the first end of the bar.

2. A system for trimming a kite in accordance with claim 1, wherein a worm gear is provided mounted between a first and second side walls of the first housing secured to the winder and a first shaft is provided with a first gear wheel thereon such that rotation of the worm gear rotates the first shaft via a gearing arrangement.

3. A system for trimming a kite in accordance with claim 2, wherein the gearing arrangement comprises further gear wheels connecting the worm gear to the first gear wheel to increase the angle of rotation of the first shaft per revolution of the worm gear relative to a direct connection between the worm gear and the first gear wheel.

4. A system for trimming a kite in accordance with claim 3, wherein there is provided a second shaft secured between the front and rear walls of a first housing including a second gear wheel and a third gear wheel mounted thereon such that the second gear wheel engages with the worm gear and the third gear wheel engages with the first gear wheel on the first shaft.

5. A system for trimming a kite in accordance with claim 4, wherein a limiter is also provided to limit the extent of rotational movement of the first shaft.

6. A system for trimming a kite in accordance with claim 5, wherein the limiter comprises a limiter gear wheel engaging with the worm gear and having an irregular shaped cog such that when the irregular shaped cog engages with the worm gear, further rotation of the worm gear in that direction is prevented.

7. A system for trimming a kite in accordance with claim 1, wherein the system further comprises:

a first housing provided on the first end of the bar in which is provided the spools; and a second housing provided on a second end of the bar;

wherein the first line passes from the kite into the first housing and the second line passes into the second housing, around a roller and then through the hollow interior of the bar to the first housing.

8. A system for trimming a kite in accordance with claim 7, wherein the second housing comprises a first side wall secured adjacent the end of the bar, a second side wall remote from the bar, front and rear walls being parallel to the longitudinal axis of the bar and top and bottom walls.

9. A system for trimming a kite in accordance with claim 8, wherein the first side wall comprises a cylindrical protrusion in which is received the second end of the bar.

10. A system for trimming a kite in accordance with claim 9, wherein the second line enters the second housing through an opening in the top wall and passes around a roller provided in the second housing and out through an opening in the cylindrical protrusion into the hollow interior of the bar.

11. A system for trimming a kite in accordance with claim 10, wherein the second line enters the first housing towards a location between the first shaft and the bottom wall and a further roller is provided between the bottom wall and the spools such that the second line passes around the further roller and upwardly to the second spool.

12. A system for trimming a kite in accordance with claim 7, wherein there is provided a first spool and a second spool such that the second end of the first line is secured to the first spool and the second end of the second line is secured to the second spool.

13. A system for trimming a kite in accordance with claim 12, wherein the first and second spools are mounted to a first shaft such that rotation of the first shaft rotates the first and second spools to either wind the first and second lines onto or off the first and second spools.

14. A system for trimming a kite in accordance with claim 13, wherein the first shaft is oriented parallel to the bar and the winder comprises a rotatable arm secured to the first shaft such that rotation of the arm turns the first shaft.

15. A system for trimming a kite in accordance with claim 14, wherein the rotatable arm comprises an elongate plate secured to the first end of the first shaft including transverse handles at opposed ends thereof such that the transverse handles can be grasped by the kite surfer to turn the arm, thereby turning the first shaft.

16. A system for trimming a kite in accordance with claim 15, wherein a latch mechanism is provided in the first housing such that the latch mechanism allows rotation of the arm in a direction to wind the lines onto the spools but only allows rotation of the arm in the opposite direction by a limited amount.

17. A system for trimming a kite in accordance with claim 16, wherein the latch mechanism allows rotation of the arm in the second direction by at most one half a rotation.

18. A system for trimming a kite in accordance with claim 17, wherein the latch mechanism comprises:

a latch pin provided in the first housing; and protrusions provided on opposed ends of the arm;

wherein each protrusion comprises a first surface provided such that when the arm rotates in a first direction the first end of the latch pin rides up the first surface forcing the first end of the latch pin into the first housing and a second surface such that when the arm rotates in a second direction the first end of the latch pin engages with the second surface to prevent further rotation of the arm.

19. A system for trimming a kite in accordance with claim 18, wherein the latch pin is spring biased to move towards the arm.

20. A system for trimming a kite in accordance with claim 19, wherein the spring bias is provided by an elastic cord connected between the first housing and a second end of the latch pin.

21. A system for trimming a kite in accordance with claim 14, wherein the first housing comprises a first side wall secured adjacent the end of the bar and a second side wall remote from the bar and the first shaft extends through the second side wall such that the rotatable arm is secured to the first housing adjacent the second side wall.

22. A system for trimming a kite in accordance with claim 21, wherein the first housing comprises front and rear walls being parallel to the longitudinal axis of the bar and oriented generally vertically in use and top and bottom walls.

23. A system for trimming a kite in accordance with claim 21, wherein the first side wall includes a cylindrical protrusion into which is received the first end of the bar.

24. A system for trimming a kite in accordance with claim 23, wherein the first line extends downwardly through an opening in the top wall directly to the first spool.

* * * * *